US005377390A

United States Patent [19]

Huang

[11] Patent Number: 5,377,390

[45] Date of Patent: Jan. 3, 1995

[54] ADJUSTABLE TIE CHAIN

[76] Inventor: Yu-Lin Huang, No. 5, Alley 2, Lane 85, Min Tsu Road, Lu Chou Hsiang, Taipei Hsien, Taiwan, Prov. of China

[21] Appl. No.: 71,896

[22] Filed: Jun. 3, 1993

[51] Int. Cl.[6] ..... A44B 6/00

[52] U.S. Cl. ..... 24/49 CF

[58] Field of Search ..... 24/49 R, 49 F, 56, 58, 24/481

[56] References Cited

U.S. PATENT DOCUMENTS 1,982,188 11/1934 Wurster ..... 24/49 CF
2,037,864 4/1936 Mix ..... 24/49 CF
2,510,286 6/1950 Johnson ..... 24/49 CF

*Primary Examiner*—James R. Brittain
*Attorney, Agent, or Firm*—Pro-Techtor International

[57] ABSTRACT

An adjustable tie chain including a hanger for hanging on the tie the end of a button on a cloth, two arms pivotably fastened to the hanger by a clamping plate and at least one pivot, a chain suspended between the arms for retaining a necktie, a friction plate fastened inside the clamping plate and stopped against the arms, the hanger having an oblong center opening in width slightly shorter than the diameter of the button for positive hanging, whereby the arms can be turned toward to or apart from each other and then retained in the adjusted position.

4 Claims, 8 Drawing Sheets

ADJUSTABLE TIE CHAIN

BACKGROUND OF THE INVENTION

The present invention relates to tie chains, and more particularly the present invention relates to an adjustable tie chain which can be conveniently adjusted according to the width of the necktie to be fastened.

Various fastening devices are manufactured for and used for holding the front and rear aprons of a necktie in position. FIG. 1 illustrates a tie chain for this purpose. The tie chain is comprised of a hanging bar 10, and a chain 11 having two opposite ends respectively fastened to the two opposite ends of the hanging bar 10. The hanging bar 10 has a hanging hole 12 in the middle, and an opening 13 made gradually smaller toward the hanging hole 12. Referring to FIG. 2, by means of the opening 13 and the hanging hole 12, the hanging bar 10 can be easily hung on the tie thread 15 of the button 14 for allowing the necktie 20 to be retained to the cloth by the chain 11. This structure of tie chain still has drawbacks. One drawback of this structure of tie chain is that the tie chain can not be adjusted according to the pitch between the two opposite long sides 21;22 of the front apron of the necktie 20. If the tie chain is fastened at a higher elevation, it can not hold the necktie in position; if the tie chain is fastened at a lower elevation, the front apron of the necktie may be wrinkled. Another drawback of this structure of tie chain is that the hanging bar 10 may disconnect from the tie thread 15 of the button 14 while one is jumping or shaking the body heavily.

SUMMARY OF THE INVENTION

The present invention eliminates the aforesaid drawbacks. According to one aspect of the present invention, the adjustable tie chain comprises two pivoted arms connected to a hanger and retained engaged by a friction plate, and a chain suspended between the pivoted arms, whereby the pivoted arms can be turned toward to or apart from each other to adjust the contained angle therebetween according to the size of the necktie to be retained.

According to another aspect of the present invention, the hanger is made from an oblong open frame having an oblong center opening in width slightly shorter than the diameter of the button for positive hanging.

DETAILED DESCRIPTION OF THE PREFERRED EMBODIMENTS

Figure 1:
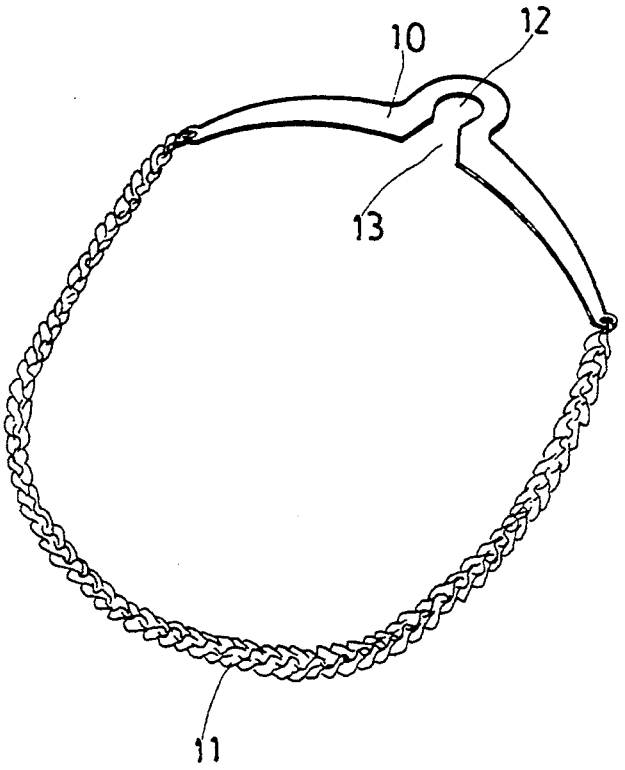
FIG. 1 PRIOR ART
FIG. 1 is a perspective view of a tie chain according to the prior art.
Figure 2:
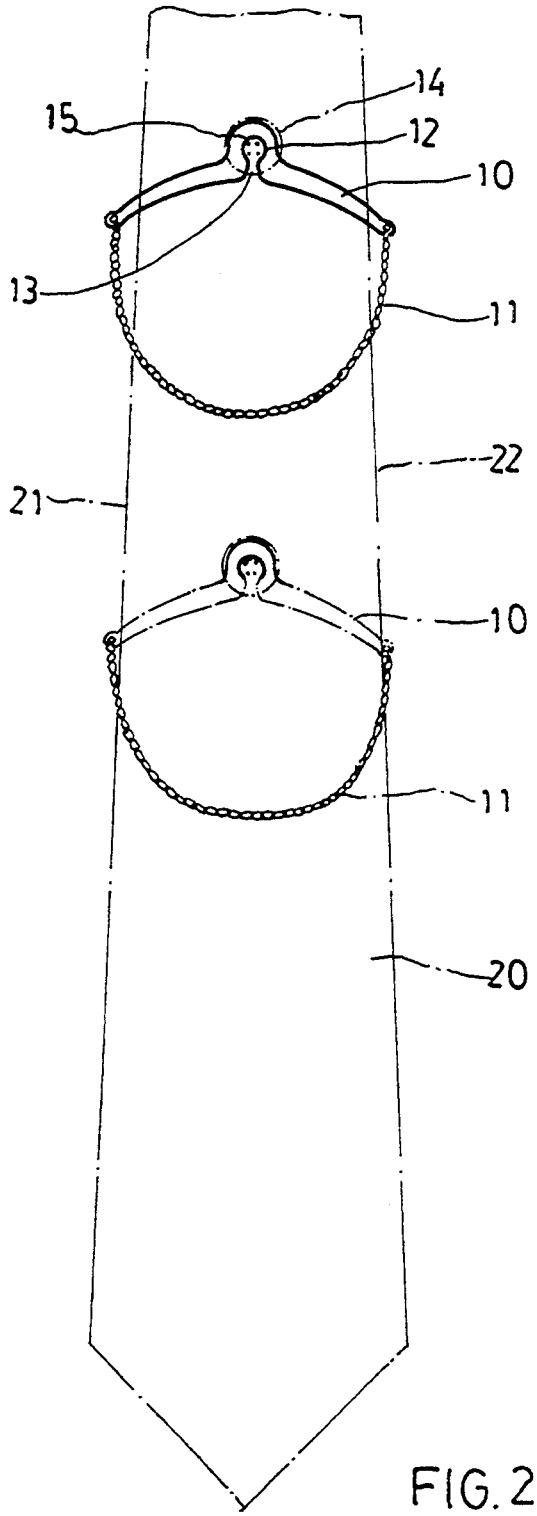
FIG. 2 PRIOR ART
FIG. 2 is a schematic drawing showing the tie chain of FIG. 1 fastened at different positions.
Figure 3:
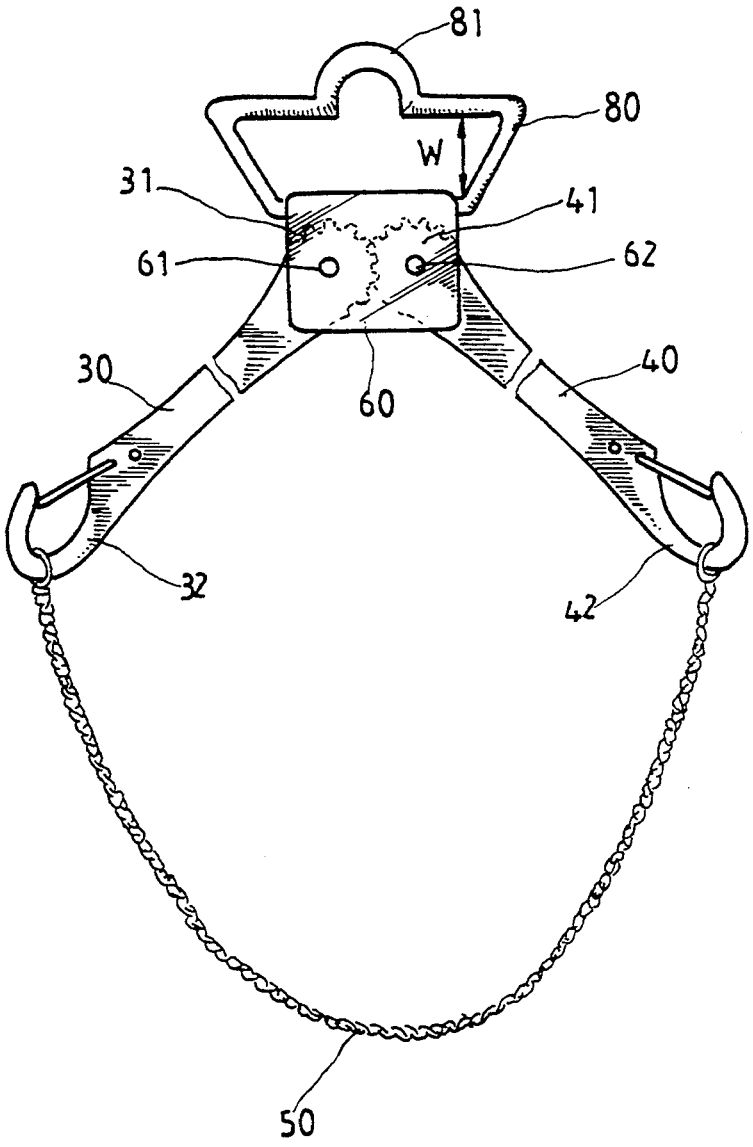
FIG. 3 is a perspective view of a tie chain according to the present invention.
Figure 4:
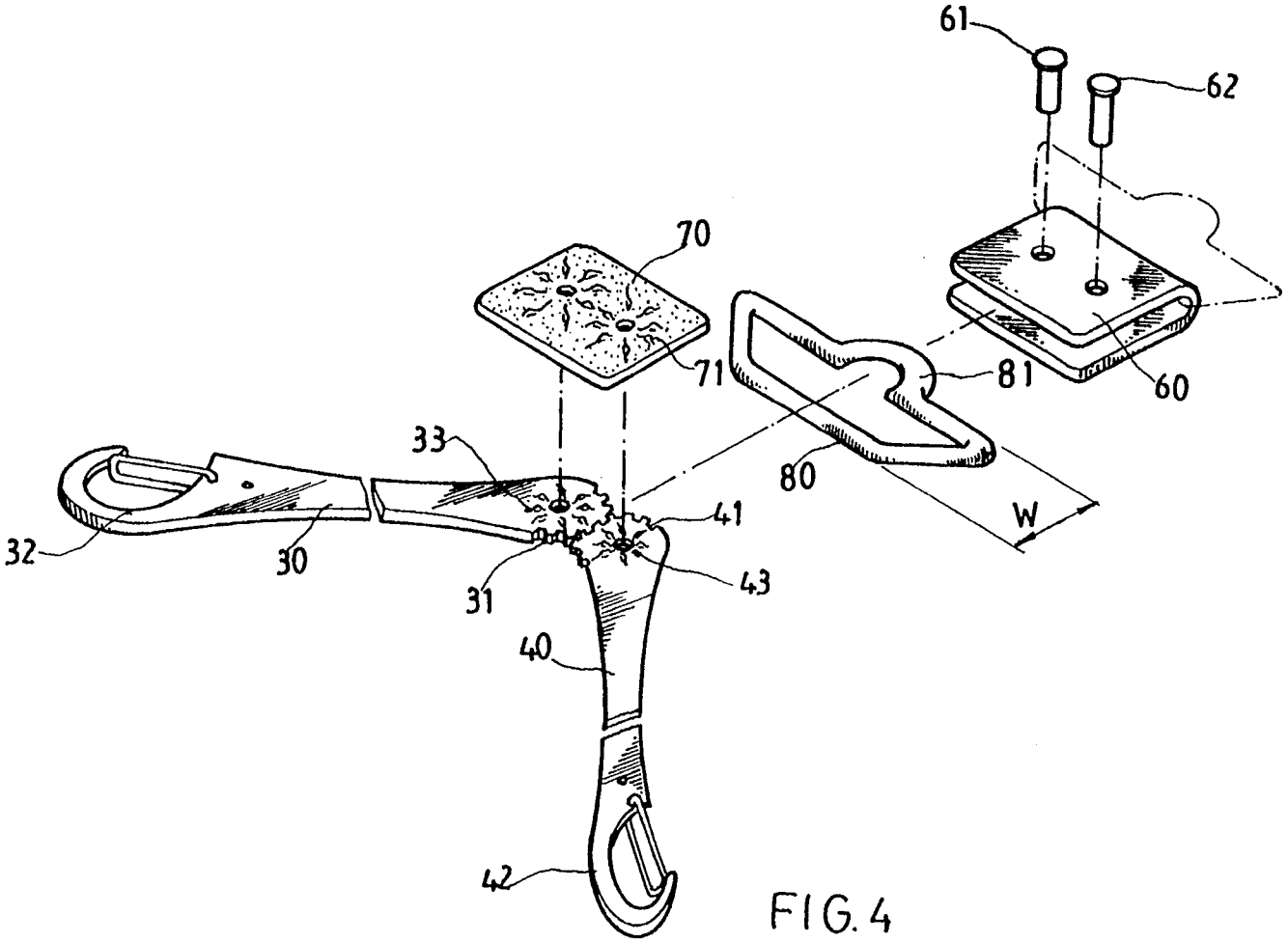
FIG. 4 is an exploded view of the tie chain shown in FIG. 3.
Figure 5:
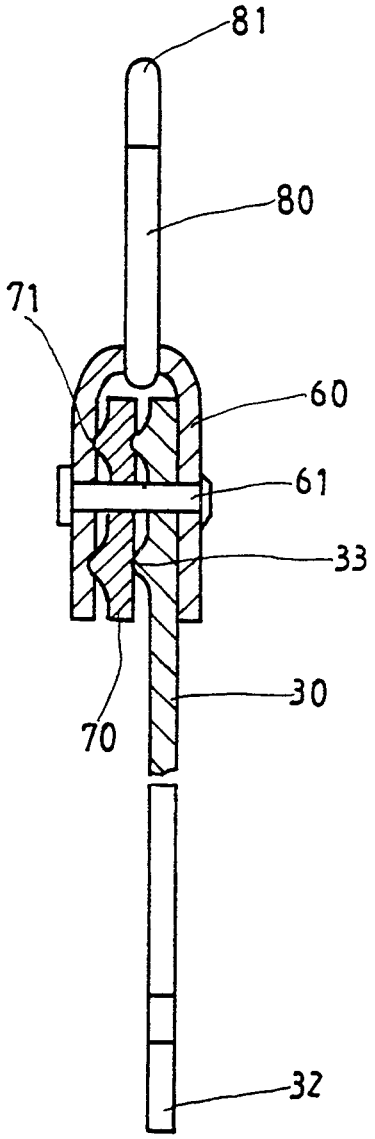
FIG. 5 is a sectional view of the tie chain shown in FIG. 3.

Referring to FIGS. 3, 4 and 5, a tie chain in accordance with the present invention is generally comprised of two arms 30;40, a chain 50, a substantially U-shaped clamping plate 60, a friction pad 70, and a hanger 80. The arms 30;40 are symmetrical, each having one end terminated to a toothed portion 31 or 41 meshed with each other and an opposite end terminated to a hooked portion 32 or 42 to hold either end of the chain 50. The friction pad 70 is attached to the meshed toothed portions 31;41 at one side, then the friction pad 70 and the meshed toothed portions 31;41 are inserted in the substantially U-shaped clamping plate 60 and then fastened in place by rivets 61;62 for allowing the arms 30;40 to be pivoted on either rivet 61 or 62. The hanger 80 is made of an open frame having a hanging hole 81 on one long side thereof in the middle. During the assembly process, the hanger 80 is hung on the clamping plate 60, then the arms 30;40 and the friction pad 70 are fastened to the clamping plate 60 by the rivets 61;62. Further, the toothed portion 31 of 41 of each arm 30 or 40 has a corrugated upper surface 33 or 43. The friction pad 70 also has a corrugated upper surface 71. The arrangement of the corrugated upper surfaces 33;43;71 are to increase friction force for positive positioning. The width W between two opposite horizontal side walls of the open frame 80 is slightly smaller than the diameter of the buttons on the shirt.

Figure 6:
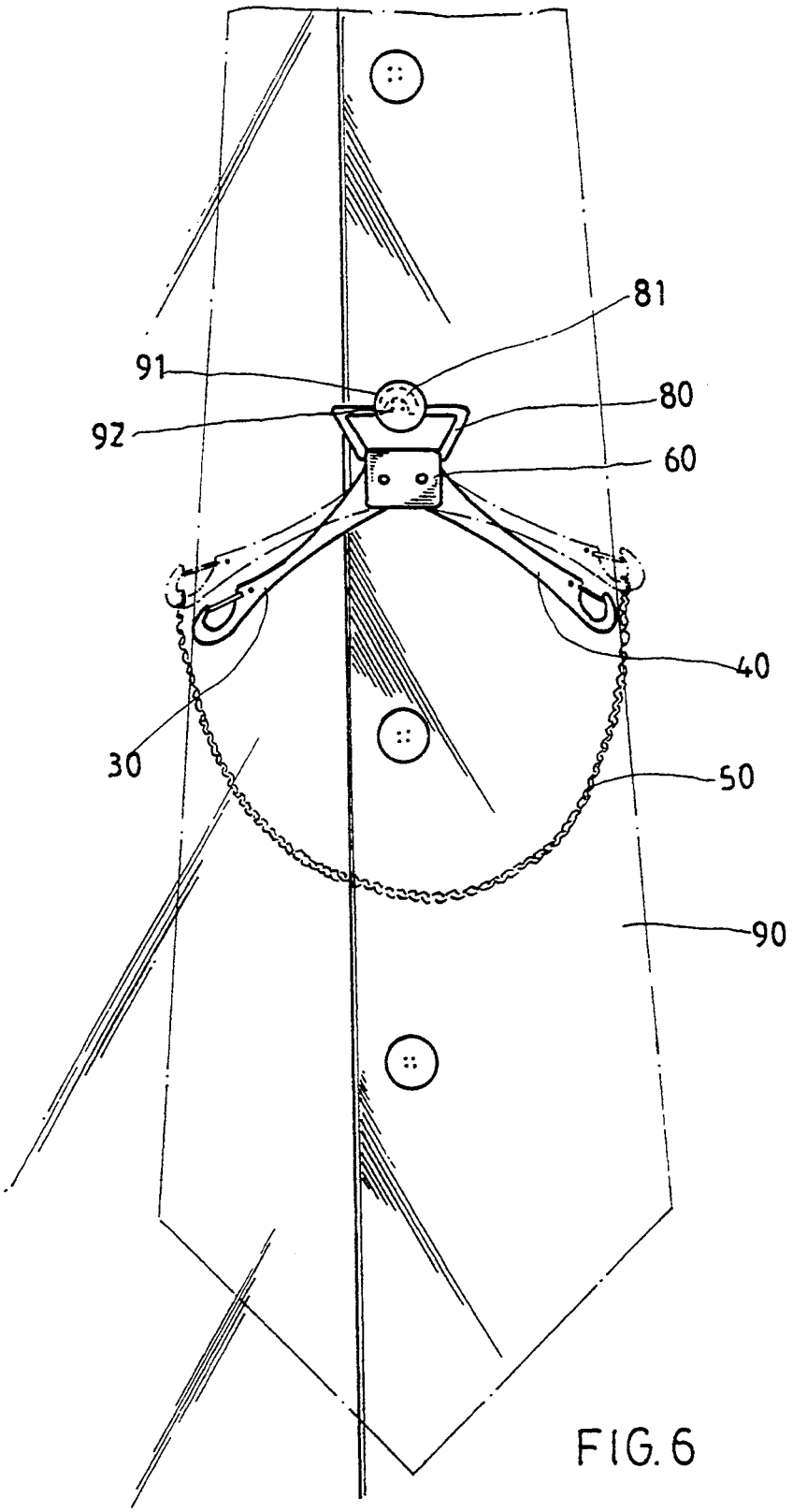
FIG. 6 is an installed view showing the tie chain of the present invention adjusted to hold the necktie in position.

Referring to FIG. 6, by means of the hanger 80, the tie chain can be conveniently hung on the tie thread 92 of the button 91 to hold the necktie 90 by the chain 50. When installed, the arms 30;40 are turned relative to each other to adjust the contained angle therebetween according to the width of front apron of the necktie 90.

Figure 7:
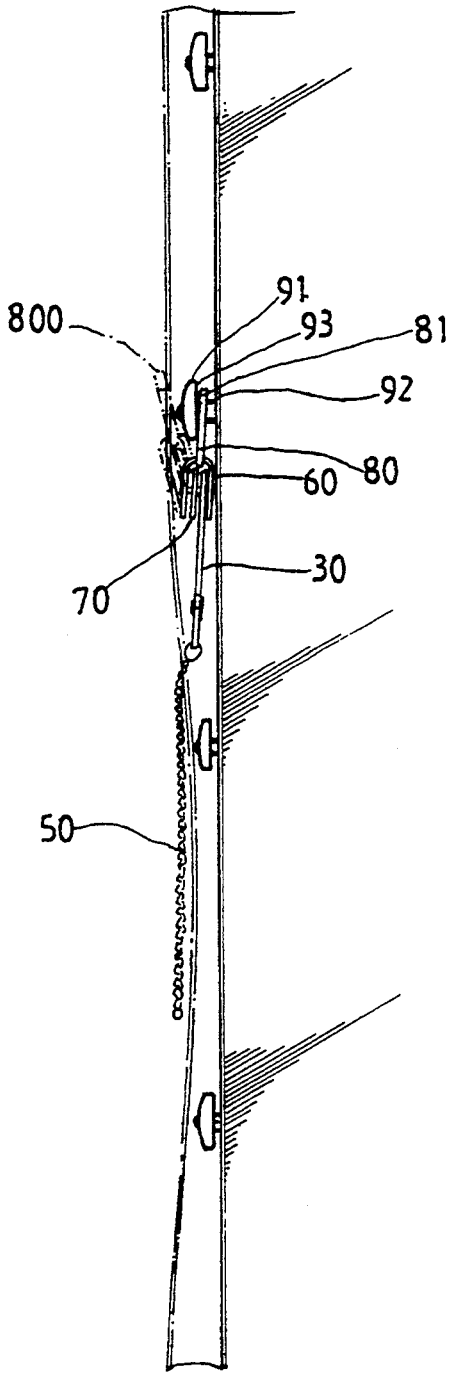
FIG. 7 is a side view of FIG. 6.

Referring to FIG. 7 and FIG. 6 again, the hanger 80 is disposed in a sloping position 800 for allowing the button 91 to pass through open frame body of the hanger 80 so that the hanging hole 81 is hung on the tie thread 92 of the button 91 and disposed in contact with the back wall 93 of the button 91. Because the width W of the two opposite horizontal side walls of the hanger 80 is slightly smaller than the diameter of the button 91, the hanger 80 will not disconnect from the button 91 when hung.

Figure 8:
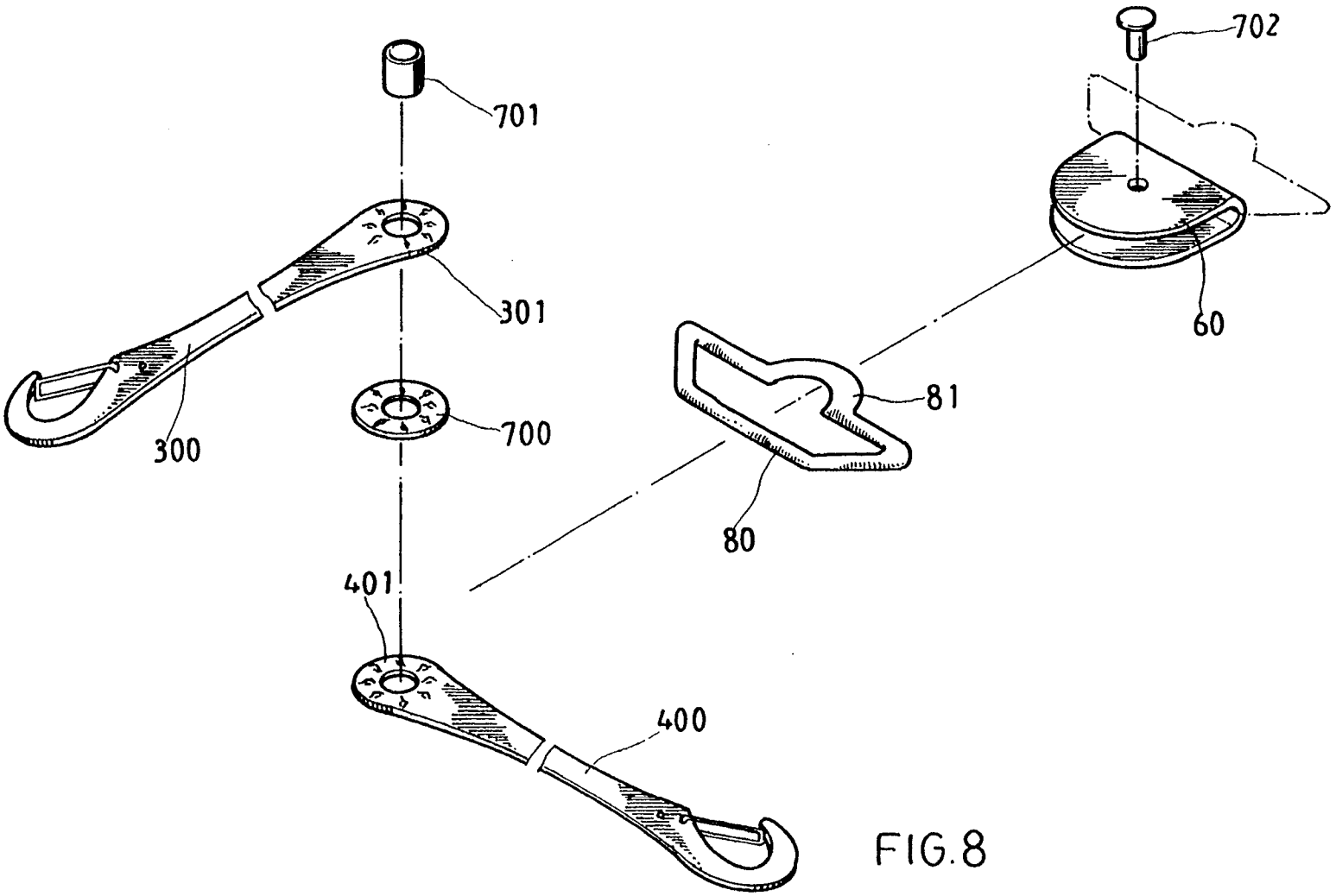
FIG. 8 is an exploded view of an alternate form of the present invention.

Referring to FIG. 8, therein illustrated is an exploded view of an alternate form of the present invention, which is comprised of two arms 300;400, a friction ring 700, a bushing 701, a hanger 80, a clamping plate 60, and a chain (not shown) connected between the arms 300;400.. Each arm 300;400 has an eye end 301 or 401 connected together by the bushing 701 with the friction ring 700 retained therebetween. The bushing 701 is fastened inside the clamping plate 60 by a rivet 702 for allowing the arms 300;400 to be respectively pivoted thereon. Similar to the aforesaid first embodiment of the present invention, the eye end 301 as well as the friction ring 700 has a respective upper corrugated surface for positioning. When assembled, the arms 300;400 can be turned relative to each other to adjust the contained angle therebetween according to the size of the necktie to be retained.

What is claimed is:

1. An adjustable tie chain comprising a hanger for hanging on the tie thread of a button on a cloth, a clamping plate fastened to said hanger, two arms each having one end pivotably connected to said clamping plate and an opposite end terminated to a hook, a chain having two opposite ends respectively connected to the hook on either arm, a friction plate fastened inside said clamping plate and stopped against said arms for allowing said arm to be turned toward to or apart from each other and then retained in the adjusted position.

2. The adjustable tie chain according to claim 1 wherein said arms each has one end terminated to a toothed portion meshed with each other and pivotably connected to said clamping plate by a respective rivet.

3. The adjustable tie chain according to claim 1 wherein said hanger comprises a keystone-shaped open frame including a semi-circular projection forming a hanging hole on one long side thereof, the width of said open frame being slightly shorter than the diameter of the button on which said hanger is to be hung, so that the hanger will not accidentally be removed from the button.

4. The adjustable tie chain according to claim 1 wherein said arms each has one end respectively and pivotably connected to said clamping plate by a pivot with said friction plate retained therebetween.

* * * * *